US009562536B2

(12) United States Patent
Jiang

(10) Patent No.: US 9,562,536 B2
(45) Date of Patent: Feb. 7, 2017

(54) FAN STRUCTURE

(71) Applicant: AEROCOOL ADVANCED TECHNOLOGIES CORPORATION, New Taipei (TW)

(72) Inventor: Charng-Yen Jiang, New Taipei (TW)

(73) Assignee: Aerocool Advanced Technologies Corporation, New Taipei (TW)

( * ) Notice: Subject to any disclaimer, the term of this patent is extended or adjusted under 35 U.S.C. 154(b) by 477 days.

(21) Appl. No.: 14/197,338

(22) Filed: Mar. 5, 2014

(65) Prior Publication Data

US 2015/0050133 A1 Feb. 19, 2015

(30) Foreign Application Priority Data

Aug. 15, 2013 (TW) ..... 102215351 U

(51) Int. Cl.

| | |
|---|---|
| ***F04D 29/32*** | (2006.01) |
| ***F04D 29/38*** | (2006.01) |
| ***F04D 29/54*** | (2006.01) |
| ***F04D 19/00*** | (2006.01) |
| ***F04D 25/06*** | (2006.01) |
| ***F04D 29/66*** | (2006.01) |

(52) U.S. Cl.

CPC ..... *F04D 19/002* (2013.01); *F04D 25/0613* (2013.01); *F04D 29/325* (2013.01); *F04D 29/384* (2013.01); *F04D 29/388* (2013.01); *F04D 29/544* (2013.01); *F04D 29/664* (2013.01)

(58) Field of Classification Search

CPC .... F04D 19/002; F04D 29/325; F04D 29/382; F04D 29/38; F04D 29/384; F04D 29/388; F04D 29/541; F04D 29/542; F04D 29/544; F04D 29/663; F04D 29/668;F04D 29/664; F05B 2240/311; F05B 2240/30; F05B 2240/301; F05B 2240/302; F05B 2260/96; F05B 2260/964

USPC .. 415/119, 220, 223, 208.2, 211.2; 416/240, 416/241 A, 236 R, 236 A, 500, 62, 132 R, 4/16183, 185, 186 R, 223 R, 228, 212 R, 416/213 A, 224, 229 R, 230, 234

See application file for complete search history.

(56) References Cited

U.S. PATENT DOCUMENTS

| | | | | |
|---|---|---|---|---|
| 6,779,992 | B2 * | 8/2004 | Lei | F04D 29/325 416/198 R |
| 7,182,572 | B2 * | 2/2007 | Yang | F04D 29/329 415/175 |
| 7,618,236 | B2 * | 11/2009 | Hsu | F04D 29/542 415/121.2 |
| 7,661,927 | B2 * | 2/2010 | Hsu | H05K 7/20172 415/121.2 |

(Continued)

FOREIGN PATENT DOCUMENTS

| | | | | |
|---|---|---|---|---|
| JP | 3171537 U | * 11/2011 | ..... | F04D 29/64 |

*Primary Examiner* — Christopher Verdier
(74) *Attorney, Agent, or Firm* — Rosenberg, Klein & Lee

(57) ABSTRACT

A fan structure includes a fan rack including an accommodation open chamber, a center base suspended at the center of the bottom side of the accommodation open chamber and a plurality of connection ribs radially connected between the center base and the inner perimeter of the fan rack, and a fan including a fan body made from a hard plastic or rubber material and rotatably mounted at the center base of the fan rack and a soundproofing molding made from a flexible plastic or rubber material and directly molded on the fan body. Thus, during rotation of the fan to induce currents of air, the flexible material property of the soundproofing molding reduces air resistance and wind noise.

10 Claims, 7 Drawing Sheets

(56) References Cited

U.S. PATENT DOCUMENTS

| | | | | |
|---|---|---|---|---|
| 8,231,343 | B2 * | 7/2012 | Kayama | F04D 25/0613<br>415/220 |
| 8,297,922 | B2 * | 10/2012 | Cruickshank | F04D 29/289<br>416/1 |
| 9,222,479 | B2 * | 12/2015 | Wei | F04D 25/0613 |
| 2006/0034697 | A1 * | 2/2006 | Chen | F04D 29/667<br>416/231 R |
| 2008/0247864 | A1 * | 10/2008 | Chang | F04D 25/0613<br>415/119 |
| 2010/0129235 | A1 * | 5/2010 | Qian | F04D 29/668<br>417/363 |
| 2012/0168134 | A1 * | 7/2012 | Tsao | G03B 21/16<br>165/121 |

* cited by examiner

FAN STRUCTURE

This application claims the priority benefit of Taiwan patent application number 102215351, filed on Aug. 15, 2013.

BACKGROUND OF THE INVENTION

1. Field of the Invention

The present invention relates electrical fan technology and more particularly, to a fan structure that comprises a fan rack, and a fan that comprises a fan body made from a hard heat-resistant plastic or rubber material, and a soundproofing molding made from a flexible plastic or rubber material and directly molded on the fan body. Thus, the flexible material property of the soundproofing molding can effectively reduce air resistance and wind noise during rotation of the fan.

2. Description of the Related Art

With fast development of computer technology, computer operating speed and processing ability have been greatly improved, and many high-power central processing units (CPUs), graphics processing units (GPUs) and power supply units (PSU) have been created and widely used in different computer products. However, during operation of a high-power CPU, GPU, PSU or other electronic devices, a large amount of waste heat can be produced, increasing the internal temperature of the computer device. Poor air circulation of the computer device can actually endanger the internal component parts of the computer device. Therefore, it is an important work to solve the problem of heat dissipation in a computer device.

Heat sinks are commonly used with electrical fans in computer devices for dissipating heat from heat-generating electronic component parts. An electrical fan can be arranged in a computer device to intake external cold air toward a specific heat-generating electronic component part, cooling down the temperature of the heat-generating electronic component part. Alternatively, the electrical fan can be mounted in the computer device in the reversed direction to draw hot air from the heat-generating electronic component part toward the outside of the computer device.

However, during rotation of an electrical fan in a computer device, much noise is produced as the fan blades are cutting through the air, leading to aerodynamic instability at high speeds.

SUMMARY OF THE INVENTION

The present invention has been accomplished under the circumstances in view. It is therefore the main object of the present invention to provide a fan structure, which reduces drag and wind noise and prevents aerodynamic instability at high speeds.

To achieve this and other objects of the present invention, a fan structure of the present invention comprises a fan rack that comprises an accommodation open chamber, a center base suspended at the center of the bottom side of the accommodation open chamber and a plurality of connection ribs radially connected between the center base and the inner perimeter of the fan rack, and a fan mounted in the accommodation open chamber of the fan rack. The fan comprises a fan body made from a hard heat-resistant plastic or rubber material, and a soundproofing molding made from a flexible plastic or rubber material and directly molded on the fan body. Therefore, the flexible material property of the soundproofing molding can effectively reduce air resistance and wind noise during rotation of the fan.

Further, during operation of the fan, buffer portions of the soundproofing molding are rotated to move air, and flow guide blocks at the buffer portions guide induced currents of air toward the inside or outside of the accommodation open chamber of the fan rack, reducing drag and wind noise and preventing aerodynamic instability at high speeds.

Further, if the fan is arranged to draw air out of the accommodation open chamber of the fan rack, flow-guide grooves that are obliquely formed in each connection rib of the fan rack effectively guide the outward flow of air toward the outside of the accommodation open chamber of the fan rack, reducing impact of air on the connection ribs.

Further, the fan rack further comprises a mating connection structure at each of four corners thereof Each mating connection structure of the fan rack comprises two flange plates disposed in parallel at different elevations, a back groove disposed at a back side relative to the two flange plates and facing toward the accommodation open chamber and a mating buffer member mounted in the back groove. The mating buffer member comprises two caps respectively capped on the two flange plates, a curved connection strip connected between the two caps and attached to the associating back groove, and a plurality of silencer blocks at the curved connection strip. During operation of the fan, the flexible material property of the silencer blocks at the curved connection strips of the mating buffer members absorb shock waves and noises caused by the rotation of the fan.

DETAILED DESCRIPTION OF THE PREFERRED EMBODIMENT

Figure 1:
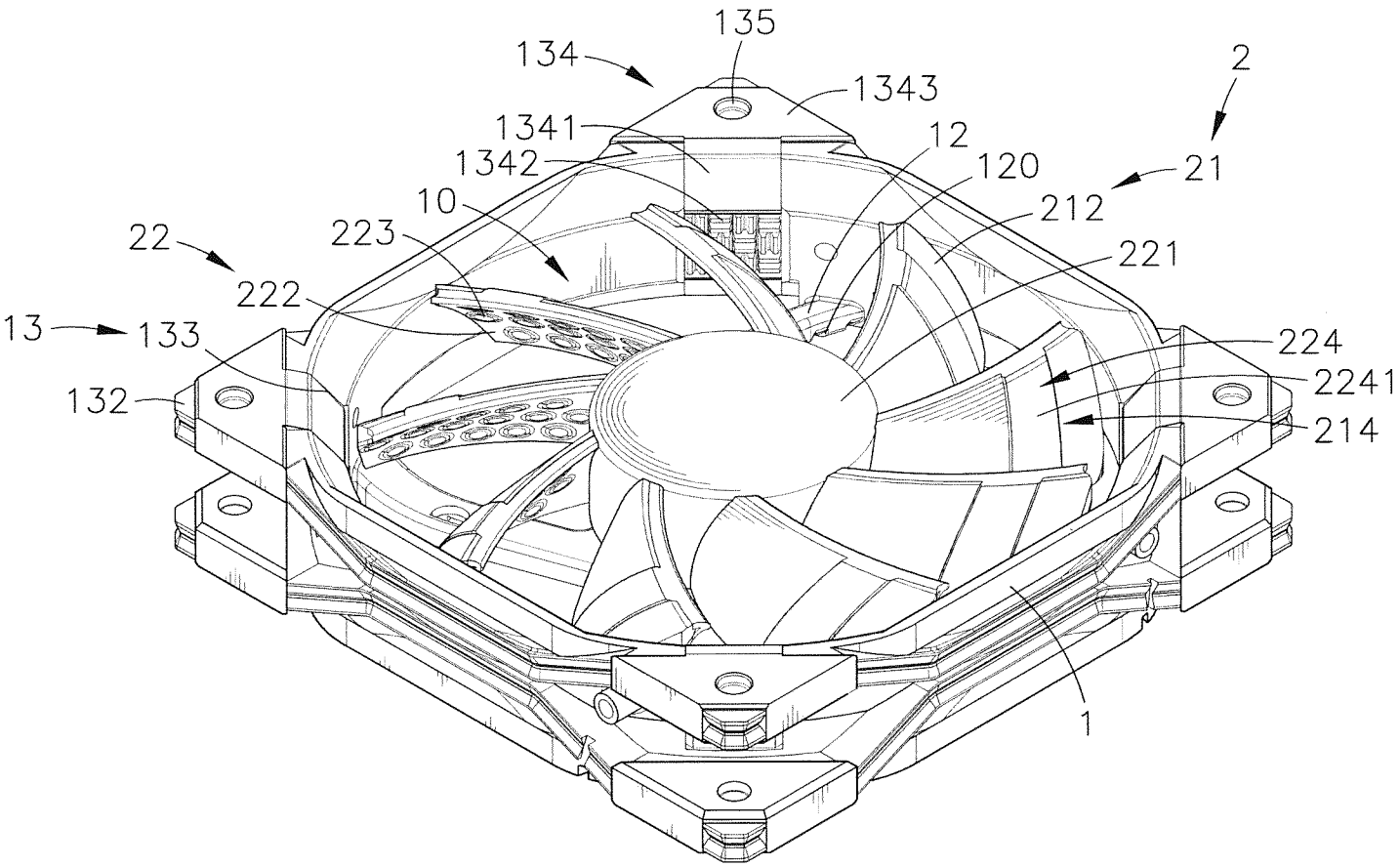
FIG. 1 is an oblique top elevational view of a fan structure in accordance with the present invention.
Figure 2:
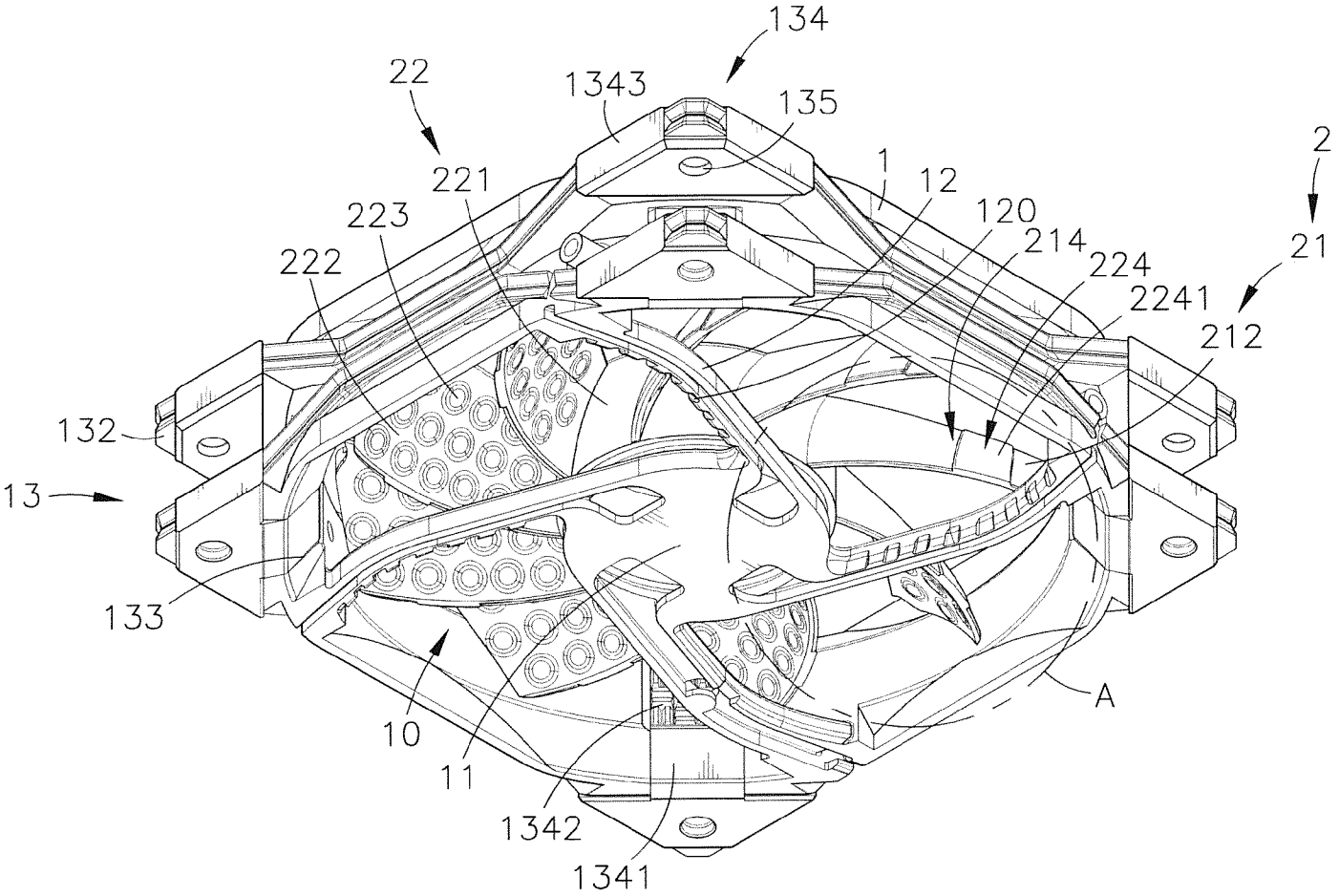
FIG. 2 is an oblique bottom elevational view of the fan structure in accordance with the present invention.
Figure 3:
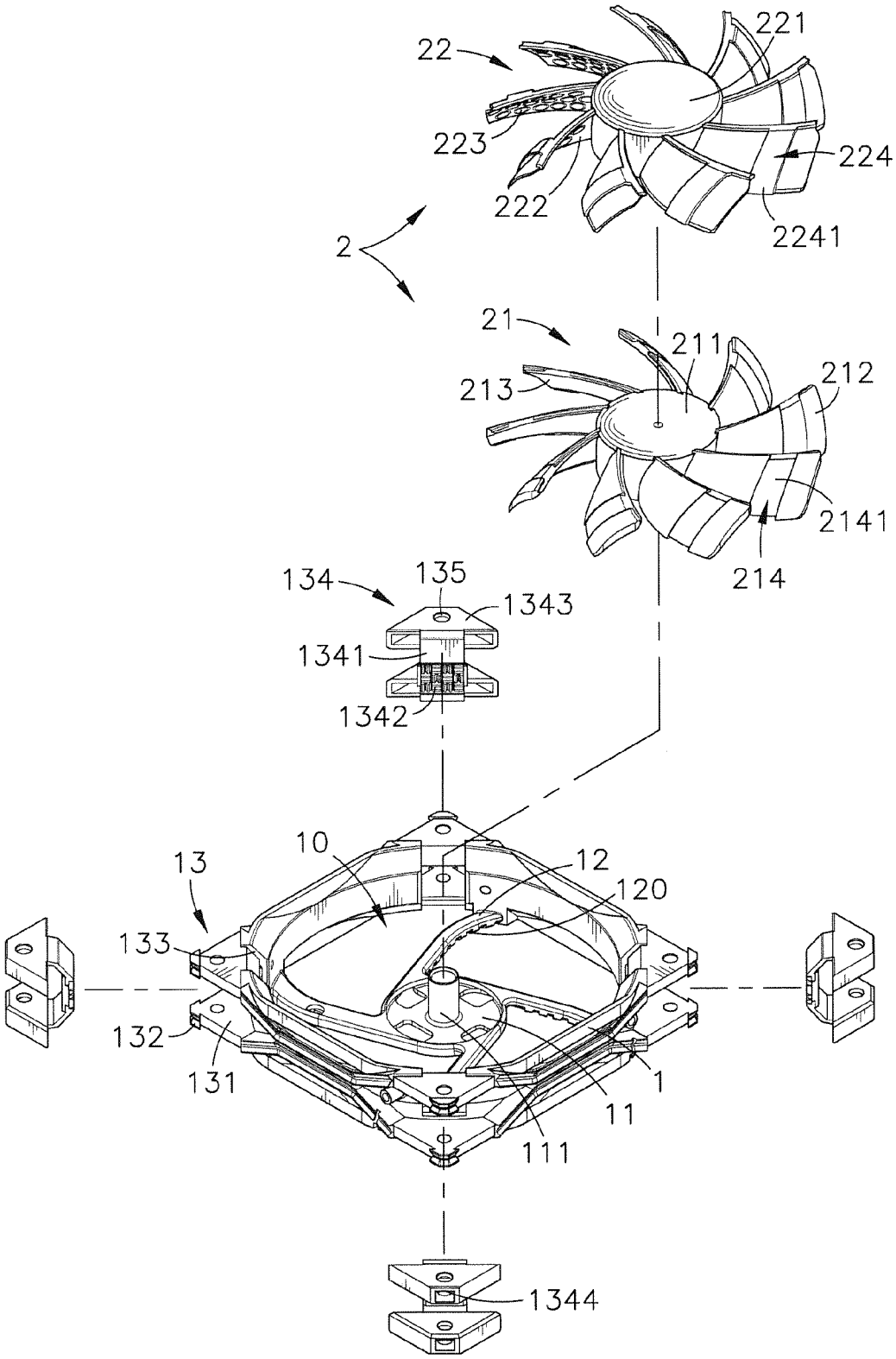
FIG. 3 is an exploded view of the fan structure in accordance with the present invention.
Figure 4:
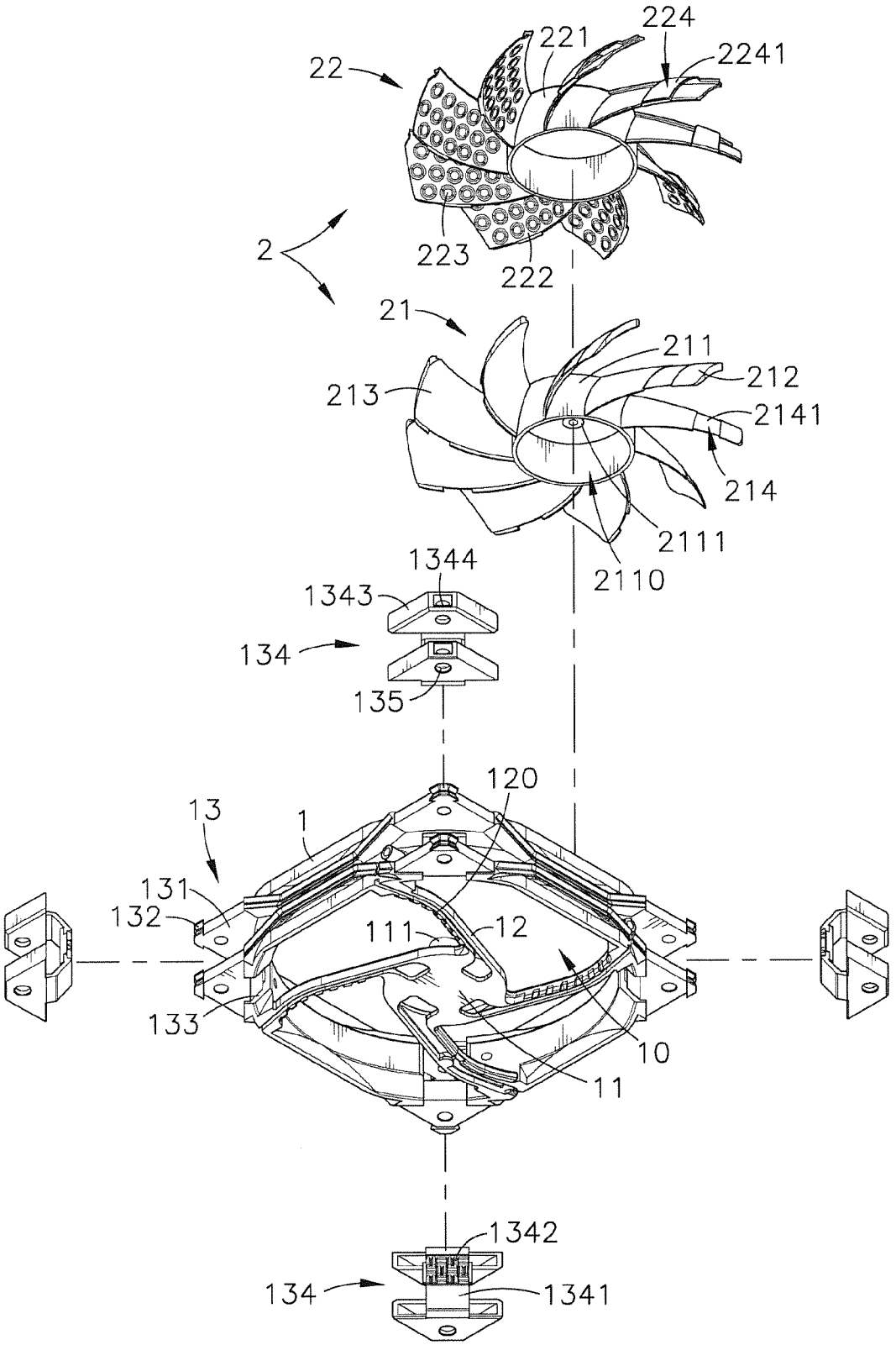
FIG. 4 is similar to FIG. 3 when viewed from another angle.
Figure 5:
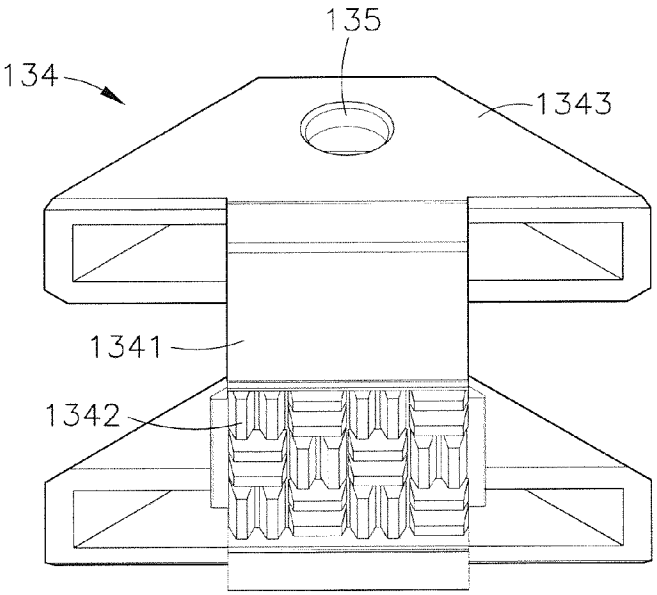
FIG. 5 is an elevational view of a mating buffer member for the fan structure in accordance with the present invention.

Referring to FIGS. 1-5, a fan structure in accordance with the present invention is shown. As illustrated, the fan structure comprises a fan rack 1, and a fan 2.

The fan rack 1 comprises an accommodation open chamber 10 extending through opposing top and bottom sides thereof, a center base 11 suspended at the center of a bottom side of the accommodation open chamber 10, an upright axle tube 111 perpendicularly upwardly extended from the center base 11 and projecting into the accommodation open chamber 10, a plurality of connection ribs 12 radially and equiangularly connected between the center base 11 and the inner perimeter of the fan rack 1, a plurality of flow-guide grooves 120 obliquely formed in each connection rib 12 in a parallel manner, and a mating connection structure 13 located in each of four corners thereof. Each mating connection structure 13 comprises two flange plates 131 disposed in parallel at different elevations, a stop block 132 located at an outer end of each of the two flange plates 131, a back groove 133 disposed at a back side relative to the two flange plates 131 and facing toward the accommodation open chamber 10, and a mating buffer member 134 mounted in the back groove 133. The mating buffer member 134 is preferably made from a flexible plastic or rubber material by molding, comprising two caps 1343 respectively capped on the flange plates 131, a curved connection strip 1341 connected between the two caps 1343 and attached to the associating back groove 133, and a plurality of silencer blocks 1342 located at an outer wall of the curved connection strip 1341 and facing toward the accommodation open chamber 10, and a mounting through hole 135 vertically cut through each of the two caps 1343 and each of the two flange plates 131. Further, each cap 1343 has a front end hole 1344 abutted against a bottom side of the stop block 132 at the associating flange plate 131.

The fan 2 comprises a fan body 21 made from a hard plastic or rubber material, and a soundproofing molding 22 made from a flexible plastic or rubber material and directly molded on the fan body 21. The fan body 21 comprises a hub 211 defining therein a bottom open chamber 2110, an axle sleeve 2111 downwardly extended from a top wall of the hub 211 and suspending in the bottom open chamber 2110 at the center, and a plurality of radial blades 212 spirally and equally spaced around the outer perimeter of the hub 211. Each radial blade 212 defines an inner blade surface 213, an outer bearing surface 214, and a groove 2141 transversely located at the outer bearing surface 214 at a location far from the hub 211. The soundproofing molding 22 comprises a hub covering 221 molded on the hub 211 of the fan body 21, a plurality of buffer portions 222 respectively molded on the inner blade surfaces 213 of the radial blades 212 of the fan body 21, a plurality of flow guide blocks 223 located at the buffer portions 222, and a locating part 224 comprising a plurality of locating strips 2241 that are respectively molded in the grooves 2141 at the outer bearing surfaces 214 of the radial blades 212 of the fan body 21.

Further, the soundproofing molding 22 can be directly molded on the fan body 21 by overmolding or twin-shot injection molding.

Figure 7:
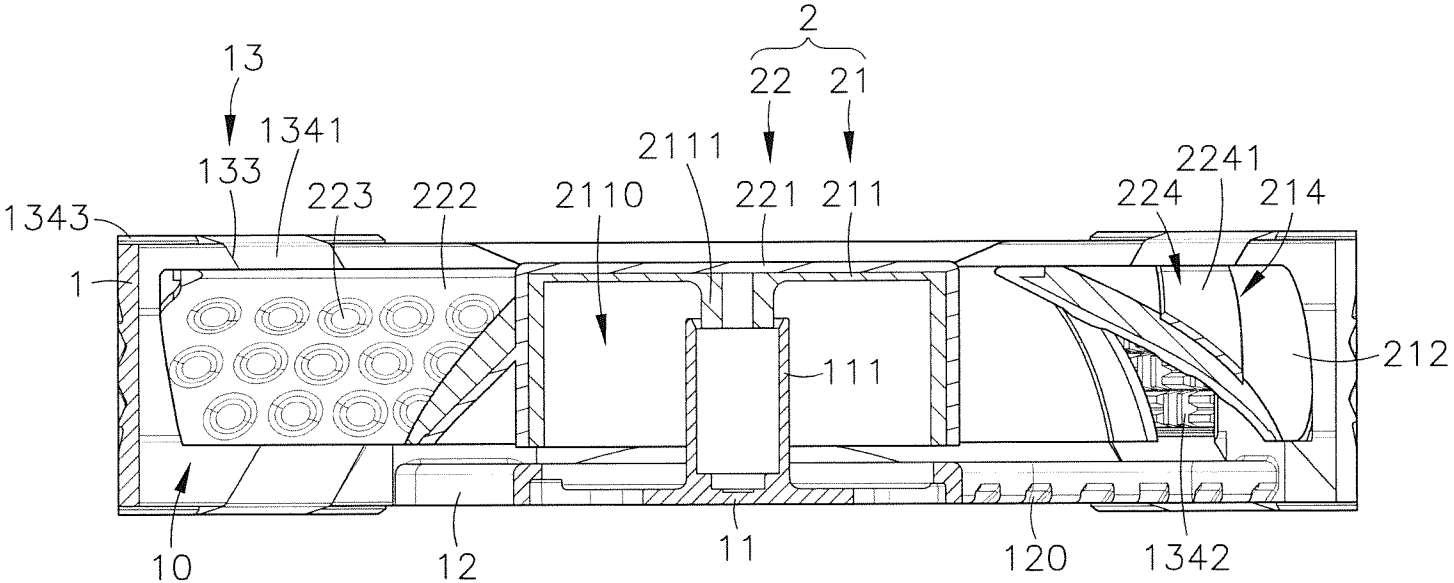
FIG. 7 is a sectional side view of the fan structure in accordance with the present invention.

Referring to FIG. 7 and FIGS. 1-4 again, during installation of the present invention, mount a fan motor (not shown) in the upright axle tube 111 of the fan rack 1 with the output shaft of the fan motor facing upward, and then insert the fan 2 into the accommodation open chamber 10 of the fan rack 1 to couple the axle sleeve 2111 of the hub 211 of the fan body 21 to the output shaft of the fan motor, enabling the fan motor and the upright axle tube 111 to be received in the bottom open chamber 2110 within the hub 211 of the fan body 21. Thus, the fan motor can be electrically conducted to rotate the fan 2 in the fan rack 1, inducing currents of air.

As stated above, the fan body 21 of the fan 2 is made from a hard plastic or rubber material, and the soundproofing molding 22 of the fan 2 is made from a flexible plastic or rubber material and directly molded on the fan body 21, therefore, the fan body 21 has better heat tolerance than the soundproofing molding 22, and thus, molding the soundproofing molding 22 on the fan body 21 does not cause deformation of the fan body 21, assuring high quality of the fan 2.

Figure 6:
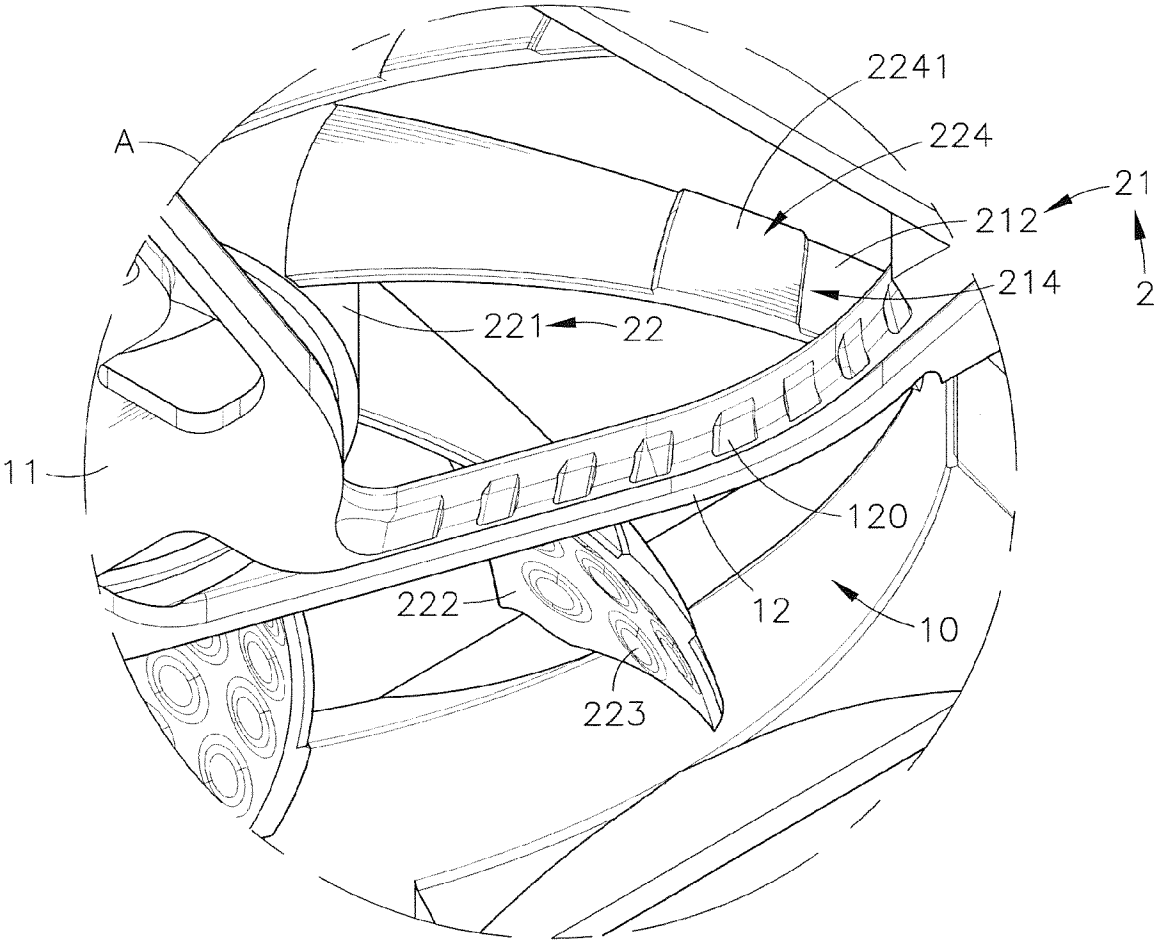
FIG. 6 is an enlarged view of Part A of FIG. 2.

Referring to FIG. 6 and FIGS. 1-5 and 7 again, in the application of the present invention, insert respective screws through the mounting through hole 135 of the caps 1343 of the mating buffer members 134 and the flange plates 131 of the mating connection structures 13 of the fan rack 1 to affix the fan rack 1 to a frame structure inside a computer over a CPU, GPU or any other heat source that needs to be cooled down. Thereafter, electrically connect the fan motor in the fan 2 of the fan structure to the power supply unit of the computer. When the fan motor is started, the axle sleeve 2111 of the hub 211 of the fan body 21 is continuously rotated by the fan motor, causing rotation of the soundproofing molding 22 with the fan body 21. At this time, the buffer portions 222 are moved to force currents of air toward the heat source of the computer, or alternatively, to force hot air from the space around the heat source toward the outside of the computer, lowering the internal temperature of the computer and preventing heat damage to electronic components.

Further, the fan body 21 of the fan 2 is made from a hard heat-resistant plastic or rubber material of heat tolerance better than the soundproofing molding 22, and the soundproofing molding 22 of the fan 2 is made from a flexible plastic or rubber material and directly molded on the fan body 21, and thus, molding the soundproofing molding 22 on the fan body 21 will not cause any damage to the fan body 21. Further, the hub covering 221 of the soundproofing molding 22 is directly molded on the hub 211 of the fan body 21, the buffer portions 222 of the soundproofing molding 22 are directly molded on the inner blade surfaces 213 of the radial blades 212 of the fan body 21, and the locating parts 224 of the soundproofing molding 22 are directly molded on the outer bearing surfaces 214 of the radial blades 212 of the fan body 21. During rotation of the fan 2 to induce currents of air, the flexible material property of the soundproofing molding 22 reduces air resistance and wind noise.

Therefore, during operation of the fan 2, the buffer portions 222 of the soundproofing molding 22 are rotated with the inner blade surfaces 213 of the radial blades 212 of the fan body 21 to move air, and the flow guide blocks 223 at the buffer portions 222 guide induce currents of air toward the inside or outside of the accommodation open chamber 10 of the fan rack 1, reducing drag and wind noise and preventing aerodynamic instability at high speeds.

Further, the flow-guide grooves 120 obliquely formed in each connection rib 12 of the fan rack 1 effectively reduce air resistance and stabilize the current-inducing operation of the fan 2. Further, if the fan 2 is arranged to draw air out of the accommodation open chamber 10 of the fan rack 1, the flow-guide grooves 120 that are obliquely formed in each connection rib 12 effectively guide the outward flow of air toward the outside of the accommodation open chamber 10 of the fan rack 1, reducing impact of air on the connection ribs 12.

Further, during operation of the fan 2, the flexible material property of the silencer blocks 1342 at the curved connection strips 1341 of the mating buffer members 134 absorb shock waves and noises caused by the rotation of the fan 2.

In general, the invention provides a fan structure comprising a fan rack and a fan, wherein the fan rack comprises an accommodation open chamber extending through opposing top and bottom sides thereof, a center base suspended at the center of a bottom side of the accommodation open chamber, an upright axle tube perpendicularly upwardly extended from the center base and supporting a fan motor in the accommodation open chamber, and a plurality of connection ribs radially and equiangularly connected between the center base and the inner perimeter of the fan rack; the fan comprises a fan body made from a hard plastic or rubber material, and a soundproofing molding made from a flexible plastic or rubber material and directly molded on the fan body. Thus, during rotation of the fan to induce currents of air, the flexible material property of the soundproofing molding reduces air resistance and wind noise.

In actual application of the present invention, the fan structure has the advantages and features as follows:

1. The fan body 21 of the fan 2 is made from a hard heat-resistant plastic or rubber material of heat tolerance better than the soundproofing molding 22, and the soundproofing molding 22 of the fan 2 is made from a flexible plastic or rubber material and directly molded on the fan body 21, and therefore the flexible material property of the soundproofing molding 22 can effectively reduce air resistance and wind noise during rotation of the fan 2.

2. During operation of the fan 2, the buffer portions 222 of the soundproofing molding 22 are rotated with the inner blade surfaces 213 of the radial blades 212 of the fan body 21 to move air, and the flow guide blocks 223 at the buffer portions 222 guide induced currents of air toward the inside or outside of the accommodation open chamber 10 of the fan rack 1, reducing drag and wind noise and preventing aerodynamic instability at high speeds.

3. If the fan 2 is arranged to draw air out of the accommodation open chamber 10 of the fan rack 1, the flow-guide grooves 120 that are obliquely formed in each connection rib 12 effectively guide the outward flow of air toward the outside of the accommodation open chamber 10 of the fan rack 1, reducing impact of air on the connection ribs 12.

4. During operation of the fan 2, the flexible material property of the silencer blocks 1342 at the curved connection strips 1341 of the mating buffer members 134 absorb shock waves and noises caused by the rotation of the fan 2.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A fan structure, comprising:

a fan rack including an accommodation open chamber extending through opposing top and bottom sides of said accommodation open chamber, said fan rack having a plurality of corner portions, a center base suspended at the center of a bottom side of said accommodation open chamber, a plurality of connection ribs radially and equiangularly connected between said center base and an inner perimeter of said fan rack, and a mating connection structure located in each of said corner portions of said fan rack; and a fan including a fan body made from a hard material, and a soundproofing molding made from a flexible material and directly molded on said fan body, said fan body including a hub rotatably mounted at said center base of said fan rack and a plurality of radial blades spirally and equally spaced around an outer perimeter of said hub, each said radial blade defining an inner blade surface at an inner side thereof and an outer bearing surface at an opposing outer side thereof, said soundproofing molding including a hub covering molded on said hub of said fan body, a plurality of buffer portions respectively molded on the inner blade surfaces of said radial blades, and a locating part respectively molded on the outer bearing surfaces of said radial blades.

2. The fan structure as claimed in claim 1, wherein said fan rack further comprises an axle tube extending from said center base to project into the accommodation open chamber to support a fan motor; said fan body of said fan further comprises an axle sleeve extending from a wall of said hub towards said center base and connected to an output shaft of the fan motor at said axle tube.

3. The fan structure as claimed in claim 1, wherein said fan rack further comprises a plurality of flow-guide grooves formed in each said connection rib in a longitudinally spaced apart manner, wherein each flow-guide groove extends angularly between transversely opposed end portions of a corresponding connection rib to define a substantially slanted configuration.

4. The fan structure as claimed in claim 1, wherein said soundproofing molding of said fan further comprises a plurality of flow guide blocks located at said buffer portions.

5. The fan structure as claimed in claim 1, wherein said mating connection structure of said fan rack includes two flange plates disposed in parallel relative to each other at different elevations, a back groove disposed at a back side relative to said two flange plates and facing toward said accommodation open chamber and a mating buffer member mounted in said back groove, said mating buffer member including two caps respectively capped on said two flange plates and a curved connection strip connected between said two caps and attached to said back groove, a mounting through hole vertically cutting through each of said two caps and each of said two flange plates.

6. The fan structure as claimed in claim 5, wherein said mating connection structure of said fan rack further comprises a stop block located at an outer end of each of the two flange plates; each said cap of each said mating buffer member defines a front end hole abutted against a bottom side of the stop block of a corresponding flange plate.

7. The fan structure as claimed in claim 5, wherein each said mating buffer member further comprises a plurality of silencer blocks located at an outer wall of said curved connection strip and facing toward said accommodation open chamber.

8. The fan structure as claimed in claim 5, wherein said mating buffer member is selected from the group of flexible plastic and rubber materials.

9. The fan structure as claimed in claim 1, wherein said fan body is selected from the group of hard plastic and rubber materials; said soundproofing molding is selected from the group of flexible plastic and rubber materials.

10. The fan structure as claimed in claim 1, wherein each said radial blade of said fan body further comprises a groove located at the outer bearing surface of the radial blade, the groove extending between transversely opposed ends of the radial blade; and a respective locating part of of a corresponding outer bearing surface of said fan body including a locating strip respectively molded in a corresponding groove.

* * * * *